United States Patent [19]

Uno et al.

[11] Patent Number: 4,814,157

[45] Date of Patent: Mar. 21, 1989

[54] CARBON FIBERS AND METHOD FOR PRODUCING SAME

[75] Inventors: Hirofumi Uno; Hajime Asai; Fujio Nakao, all of Ohtake, Japan

[73] Assignee: Mitsubishi Rayon Co., Ltd., Tokyo, Japan

[21] Appl. No.: 12,494

[22] Filed: Feb. 9, 1987

[30] Foreign Application Priority Data

Feb. 7, 1986 [JP] Japan ..... 61-23884

[51] Int. Cl.[4] ..... D01F 9/22

[52] U.S. Cl. ..... 423/447.1; 423/447.2; 423/460; 423/461; 204/130

[58] Field of Search ..... 423/447.1, 447.2, 460, 423/461; 204/130

[56] References Cited

U.S. PATENT DOCUMENTS

| | | | |
|---|---|---|---|
| 3,306,761 | 2/1967 | Johnson | 423/460 |
| 3,671,411 | 6/1972 | Ray et al. | 204/130 |
| 3,759,805 | 9/1973 | Chapman et al. | 204/130 |
| 4,009,305 | 2/1977 | Fujimaki et al. | 423/460 |
| 4,013,527 | 3/1977 | Idota et al. | 204/130 |
| 4,234,398 | 11/1980 | Yamamoto | 204/130 |
| 4,600,572 | 7/1986 | Hiramatsu et al. | 423/447.1 |

FOREIGN PATENT DOCUMENTS

| | | | |
|---|---|---|---|
| 58-132126 | 8/1983 | Japan | 204/130 |
| 2071702 | 9/1981 | United Kingdom | 204/130 |

*Primary Examiner*—John Doll
*Assistant Examiner*—Robert M. Kunemund
*Attorney, Agent, or Firm*—Oblon, Fisher, Spivak, McClelland & Maier

[57] ABSTRACT

Disclosed are polyacrylonitrile carbon fibers excellent in substrate strength and adhesion to matrix resin wherein average nitrogen content in the whole carbon fibers which is measured by elementary analysis is 0.5–4.5% by weight and average nitrogen concentration (N/C atom number ratio) in the whole carbon fibers which is measured by elementary analysis and surface silicon concentration ($Si_{2p}/C_{1s}$ atom number ratio), surface nitrogen concentration ($N_{1s}/C_{1s}$ atom number ratio) and surface oxygen concentration ($O_{1s}/C_{1s}$ atom number ratio) which are measured by X-ray photoelectron spectroscopy satisfy the following formulas:

$$0 \leqq Si_{2p}/C_{1s} \leqq 0.02$$

$$0.67\ N/C + 0.08 \leqq O_{1s}/C_{1s} - 2\ Si_{2p}/C_{1s} \leqq 0.4$$

$$0 \leqq N_{1s}/C_{1s} - N/C \leqq 0.04$$

and method for producing the carbon fibers.

3 Claims, No Drawings

CARBON FIBERS AND METHOD FOR PRODUCING SAME

BACKGROUND OF THE INVENTION

This invention relates to carbon fibers excellent in substrate strength and adhesion to a matrix resin and a method for producing same.

Carbon fibers which have been used as reinforcing materials for composite materials are not necessarily sufficient in adhesion to matrix resins and so the surface of the carbon fibers must be activated. For this purpose, there have been employed various surface treatments such as treatments with chemical agents, vapor phase oxidation, electrolytic oxidation, etc. Among these treatments, the electrolytic oxidation is a practical surface treatment because of good operability, easiness in control of the activating reaction, saving of energy, etc.

The conventional surface treatment technique have necessarily damaged carbon fibers to cause reduction of substrate strength and thus surface treatment effect cannot be sufficiently exhibited.

Hitherto, interlaminar shear strength (referred to as "ILSS" hereinafter) has been used as a means to evaluate the adhesion strength between carbon fibers and matrix resins which constitute a composite material. However, ILSS is not so sensitive for obtaining a measure of the uneven surface treatment and other conditions of the treatment in the case of composite materials composed of carbon fibers which have been subjected to a surface treatment of more than a certain level and does not directly express the adhesion strength between the carbon fibers and the matrix resins.

On the other hand, the tensile strength in the direction perpendicular to the orientation direction of fibers which shows the peel strength between carbon fibers and matrix resin which constitute a composite material (said tensile strength is referred to as "TS⊥" hereinafter) does sensitively reflect the degree of surface treatment, unevenness of surface treatment and other effects brought about by the change of treatment conditions and is a characteristic value very important for design of composite laminate materials. However, at present, TS⊥ of composite materials containing carbon fibers subjected to the conventional surface treatment has not yet reached a practical level.

When carbon fibers are subjected to surface treatment in order to improve the adhesion strength between the carbon fibers (reinforcing material) and matrix resin, use of the conventional surface treatment technique often damages the carbon fibers to cause reduction of substrate strength and thus effect of the surface treatment cannot be sufficiently exhibited.

For improvement of the surface treatment of carbon fibers, there have been proposed regulation of crystalline orientation by electron diffraction method and regulation of oxygen concentration measured by X-ray photoelectron spectroscopy (ESCA method) both for controlling amount of surface functional groups (cf. Japanese Patent Unexamined Publication (kokai) No. 214527/83). Furthermore, there has been proposed introduction of nitrogen-containing functional group by electrolytic reduction in an electrolyte containing amine (cf. Japanese Patent Unexamined Publication (Kokai) No. 112068/84). However, none of these methods have given sufficient effects.

The surface of carbon fibers carbonized by common methods have fragile portions because the fibers undergo various chemical and mechanical damages such as rapid cooling, heating and elongation during the carbonization or friction with or pressing by a roller portion. Most of these fragile portions comprise carbon material of relatively low crystallinity and irregular structure and these portions are often starting points for tensile breaking of strands of the carbon fibers. Thus, it is effective for improvement of strand strength to eliminate the fragile portions. Further, these fragile portions are weak in bonding to carbon fiber substrate and are in easily peeling state. Therefore, TS⊥ of composite materials made using carbon fibers which have been subjected to surface treatment without eliminating the fragile portions is considered to be influenced by peeling of the fragile portions from the substrate and effect of surface treatment is not sufficiently exhibited. In fact, observation of a rupture cross-section of a test piece of a composite material reinforced with carbon fibers after subjected to a test for TS⊥ by an electron microscope reveals that there are many portions where peeling occurs in inner part of fibers near the surface layer. That is, in order to improve substrate strength of carbon fibers and peel strength of carbon fibers-reinforced composite material, it is necessary to remove fragile portions of the surface of carbon fibers without producing new defective portions to expose the surface free of defects.

As a result of the inventors' investigation of causes for the low TS⊥ of the conventional carbon fiber-reinforced composite materials, it has been found that there are fragile portions in the surface part of carbon fibers which weakly bond to fiber substrate and these fragile portions are causes for the fact that the characteristics of carbon fibers such as strength and elastic modulus of carbon fibers cannot be reflected in the composite materials and that amount of nitrogen in the inner part and amounts of nitrogen and oxygen functional groups in the surface part and amount of silicon oxide in the surface part are closely related with adhesion strength and substrate strength and especially, control of the amount of the surface nitrogen is essential for improvement of adhesion strength and substrate strength.

DESCRIPTION OF THE INVENTION

That is, the gists of this invention reside in (1) polyacrylonitrile carbon fibers wherein average nitrogen content in the whole carbon fibers measured by an elemental analysis method is 0.5–4.5% by weight and the average nitrogen concentration (N/C atom number ratio) in the whole carbon fibers measured by an elemental analysis method and surface silicon concentration ($Si_{2p}/C_{1s}$ atom number ratio), surface nitrogen concentration ($N_{1s}/C_{1s}$ atom number ratio) and surface oxygen concentration ($O_{1s}/C_{1s}$atom number ratio) which are measured by X-ray photoelectron spectroscopy method satisfy the following formulas:

$$0 \leqq Si_{2p}/C_{1s} \leqq 0.02$$

$$0.67\ N/C + 0.08 \leqq O_{1s}/C_{1s} - 2Si_{2p}/C_{1s} \leqq 0.4$$

$$0 \leqq N_{1s}/C_{1s} - N/C \leqq 0.04$$

and (2) a method for producing the above carbon fibers which comprises subjecting carbon fibers after carbonization treatment as an anode to a first stage electrolytic oxidation in an aqueous solution of a neutral or alkaline ammonium salt which has an ammonium ion concentration of 0.2–4.0 mol/l and then to a second stage electrolytic oxidation in an aqueous solution of a neutral or alkaline ammonium salt which has an ammonium ion concentration of 0.01 mol/l or more and less than 0.2 mol/l.

The ammonium ion concentration used in this invention is a value obtained by multiplying the number of ammonium group contained in one molecule of a substance by mol concentration of the substance in the aqueous solution.

This invention will be explained in more detail below.

In this invention it is necessary that the average nitrogen content in the whole carbon fibers measured by an elemental analysis method is 0.5–4.5% by weight and when the content is outside this range, enough strand strength cannot be obtained. Preferably, this is 0.5–3.5% by weight.

Silicon in the surface part of carbon fibers comes from oiling agent used for precursor and is present mostly as $SiO_2$. Since this silicon oxide causes reduction of adhesion between carbon fibers and matrix resin in composite materials, it is desired to control the surface silicon concentration ($Si_{2p}/C_{1s}$ atom number ratio) to at most 0.02, preferably less than 0.01.

The oxygen concentration in the surface part of carbon fibers is a measure for the amount of oxygen-containing functional group and if silicon remains in the surface part of carbon fibers, true amount of the oxygen-containing functional group should be evaluated after concentration of oxygen present as $SiO_2$ is excluded from the whole oxygen concentration.

The inventors have studied in detail the relation between strand strength of carbon fibers and TS⊥ of composite materials and oxygen concentration ($O_{1s}/C_{1s}$—$2Si_{2p}/C_{1s}$: which is referred to as "true oxygen concentration" hereinafter) which corresponds to the whole oxygen concentration in the surface part of fibers from which concentration of oxygen present as $SiO_2$ has been excluded. As a result, it has been found that the true oxygen concentration must be determined depending on the average nitrogen concentration N/C in the whole fibers. When the true oxygen concentration is at least 0.67 N/C+0.08 and at most 0.4, preferably at most 0.3, both the adhesion to resin and the substrate strength are superior.

This invention is further characterized in controlling the surface nitrogen concentration $N_{1s}/C_{1s}$ and the nitrogen concentration in the whole fibers N/C. In the surface part of carbon fibers which have been subjected to the conventional treatment or no treatment there are no nitrogen-containing functional groups and present a slight amount of nitrogen which comes from polyacrylonitrile precursors, but this nitrogen concentration is lower than the average nitrogen concentration in the whole fibers. However, it has become possible by applying the treatment of this invention to effectively introduce nitrogen-containing functional groups into the surface part and when the difference between $N_{1s}/C_{1s}$ and N/C is within the range of 0–0.04, strand strength of carbon fibers and TS⊥ of composite materials can be sharply increased.

It may be expected from conventional knowledge that the oxygen-containing functional group in the surface part has correlation with adhesion to matrix resin, but it is surprising that the nitrogen-containing functional group has correlation with the adhesion and the substrate strength and besides when the amount of the functional group is controlled within the range specified above, the above characteristics are markedly improved.

The surface treating method for producing carbon fibers according to this invention is characterized by electrolytic oxidation of two stages.

That is, at the first stage, using carbon fibers which have been carbonized as an anode, electrolysis treatment is carried out in an aqueous solution of a neutral or alkaline ammonium salt which has an ammonium ion concentration of 0.2–4.0 mol/l, more preferably 1.0–3.0 mol/l, whereby the surface can be made clean and free of defects. When the ammonium ion concentration is less than 0.2 mol/l, the effect of removing the fragile portions in the surface part of carbon fibers is small and when it is more than 4.0 mol/l, said removing effect is excellent, but there are problems in dissolution of the peeled fragile portions in water, effect on working atmosphere due to generation of ammonia gas from the electrolyte and cost.

It is not clear how the fragile portions of carbon fibers are removed according to the method of this invention, but it can be presumed that the fragile portions which have such structure as of relatively low crystallinity and of disorder are preferentially oxidized at the electrolysis step, thus are increased in affinity with ammonium ion in the electrolyte and are easily removed from the surface of carbon fibers.

In addition to the fragile portions, there are present impurities such as silicon oxide which reduce the adhesion to matrix resin of composite materials and it has been found that such impurities are removed by the method of this invention. According to the first stage treatment alone, introduction of oxygen into the surface of carbon fibers cope with removal of the oxidized portions and thus there cannot be performed sufficient introduction of functional group into the surface of fibers which greatly contributes to increase of adhesion between carbon fibers and matrix resins.

Therefore, in this invention, the carbon fibers which have been subjected to the above first stage treatment are further subjected to the second stage electrolysis treatment in an aqueous solution of a neutral or alkaline ammonium salt which has an ammonium ion concentration of at least 0.01 mol/l and less than 0.2 mol/l, preferably 0.05–0.15 mol/l, thereby to effectively introduce nitrogen and oxygen into the surface of carbon fibers. When the ammonium ion concentration at the second stage electrolysis is not less than 0.2 mol/l, etching effect becomes great resulting in ineffective introduction of functional group and when less than 0.01 mol/l, nitrogen cannot substantially be introduced.

The neutral or alkaline ammonium salts used in this invention have no special limitation and there may be used, for example, ammonium carbamate, ammonium carbonate, ammonium bicarbonate, tribasic ammonium phosphate, etc., alone or in combination of two or more.

If an aqueous solution of an acid such as sulfuric acid, phosphoric acid, nitric acid or the like or salt thereof is used as the electrolyte for the second stage electrolysis, oxygen may be introduced into the surface part of carbon fibers, but nitrogen-containing functional groups are not produced and the surface is roughened by etching effect to damage the carbon fibers. Therefore, strength of thus treated carbon fibers is not improved and TS⊥ of composite materials made from these carbon fibers cannot be sufficiently improved.

The treatment of carbon fibers may be carried out in the same manner as of the conventional electrolysis treatment, namely, current density may be at least 0.1 $A/m^2$ and either of batch or continuous operation may be employed. Application of current at anode terminal may be made by using roller or by contact with electrolyte. Temperature of the aqueous solution used for the treatment may be from 0° C. to 100° C., preferably about room temperature. The treating time is from several seconds to several ten minutes, preferably from 5 seconds to 5 minutes in the two electrolytes, respectively. In order to increase cleaning effect, electrolyte may be fluidized or bubbling by using inert gas or ultrasonic vibration may be utilized.

When thus obtained carbon fibers are used for making composite materials, as matrix resins which have no special limitation, there may be used, for example, epoxy resins, imide resins, unsaturated polyester resins, etc. as thermosetting resins and polyamides, polyesters, polysulfone, polyether ether ketones, polyacetal resins, polypropylenes, ABS, polycarbonates, etc. as thermoplastic resins.

The carbon fibers of this invention includes polyacrylonitrile carbon fibers and graphite fibers.

The carbon fibers used in this invention are produced, for example, by the following method.

A polymer comprising at least 95% by weight, preferably at least 98% by weight of acrylonitrile and 5% by weight or less, preferably 2% by weight or less of a copolymerizable monomer such as methyl methacrylate, methacrylic acid or the like as a precursor is spun so that the filament size is within the range of 0.1–1.8 d and the filament number is within the range of 500–30000, followed by extending by 5–40% to flameproof them and then carbonizing them in an inert gas at a temperature within the range of 300°–800° C. and further 1200°–1800° C., the temperature being varied depending on the desired modules of elasticity. The average nitrogen content of thus obtained carbon fibers measured by elemental analysis depends on the maximum carbonization temperature and as shown in Table 4 of Example 4, the average nitrogen content may vary within the range of 0.5–5% by weight when the maximum carbonization temperature is within the range 1200°–1800° C.

The following example will further illustrate this invention. In these examples, various concentrations, TS⊥ and strand strength were measured in the following manners.

(1) The average nitrogen concentration in the whole carbon fibers measured by an elemental analysis method was obtained by determining weight ratio of C, H and N by CHN CORDER Manufactured by Yanagimoto Seisakusho Co., and converting it into atom number ratio N/C.

(2) The silicon concentration ($Si_{2p}/C_{1s}$ atom number ratio), the nitrogen concentration ($N_{1s}/C_{1s}$ atom number ratio) and the oxygen concentration ($O_{1s}/C_{1s}$ atom number ratio) in the surface part of carbon fibers which were measured by obtaining ASF values (0.205, 0.170, 0.380 and 0.630) of $C_{1s}$, $Si_{2p}$, $N_{1s}$ and $O_{1s}$ and their signal intensities obtained by using ESCA device, ESCALABMK II manufactured by VG CO. when $MgK_{\alpha}$ ray was used as X-ray source and calculating atom number ratios, $Si_{2p}/C_{1s}$, $N_{1s}/C_{1s}$ and $O_{1s}/C_{1s}$ from said ASF values and their signal intensities.

(3) The TS⊥ and the strand strength were measured by the test methods described in ASTM-D 3039 and JIS-R 7601, respectively, Test pieces for measurement of TS⊥ and strand strength were made from carbon fibers which have been thoroughly washed with water and epoxy matrix resin (Pyrofil #340 manufactured by Mitsubishi Rayon Co. Ltd.).

EXAMPLE 1

Effect of the first stage surface treatment:

Each of bundles comprising 12,000 filaments of carbon fibers having a strand elasticity modulus of 24 $t/mm^2$ was subjected to continuous electrolysis treatment in 2 l of each electrolyte mentioned in Table 1 at a treating rate of 0.2 m/min and a current density of 1.4 $A/m^2$ for 10 hours and transmissivity of the electrolyte after completion of electrolysis was measured. The results are shown in Table 1.

Black substance collected from the electrolyte was analyzed to find that this was an oxide having partially a graphite structure.

From these results, it is recognized that an aqueous solution of a neutral or alkaline ammonium salt which has an ammonium ion concentration of at least 0.2 mol/l and not more than 4.0 mol/l can effectively remove the oxidized portions of surface part of carbon fibers.

TABLE 1

| Experiment No. | Electrolyte | Electrolyte concentration (mol/l) | Ammonium ion concentration (mol/l) | Transmissivity* (%) | Note |
|---|---|---|---|---|---|
| 1-1 | Ammonium carbonate | 0.25 | 0.5 | 8 | This invention |
| 1-2 | Ammonium carbonate | 0.5 | 1.0 | 6 | This invention |
| 1-3 | Ammonium carbonate | 1.0 | 2.0 | 5 | This invention |
| 1-4 | Ammonium carbonate | 1.5 | 3.0 | 5 | This invention |
| 1-5 | Ammonium bicarbonate | 1.0 | 1.0 | 6 | This invention |
| 1-6 | Ammonium bicarbonate | 2.0 | 2.0 | 5 | This invention |
| 1-7 | Tribasic ammonium phosphate | 0.17 | 0.5 | 7 | This invention |
| 1-8 | Sulfuric acid | 0.5 | — | 80 | Comparative |
| 1-9 | Phosphoric acid | 0.5 | — | 75 | Comparative |
| 1-10 | Ammonium sulfate | 0.5 | 1.0 | 78 | Comparative |
| 1-11 | Ammonium carbonate | 0.05 | 0.1 | 52 | Comparative |

*Measured at [λ] = 400 nm using distilled water as a control soluiton.

EXAMPLE 2

Effect of removal of silicon and effects of introduction of nitrogen and oxygen:

Bundles comprising 12,000 filaments and having a strand elasticity modulus of 24 $t/mm^2$ were subjected to electrolysis treatment at a treating rate of 1 m/min and under the conditions as shown in Table 2. Silicon concentration, nitrogen concentration and oxygen concentration in the surface part of thus treated carbon fibers were measured and the results are shown in Table 2 together with those of untreated carbon fibers.

From Table 2, it is seen that silicon oxide in the surface part of the carbon fibers was removed by this invention and at the same time nitrogen and oxygen were effectively introduced.

TABLE 2

| Experiment No. | Electrolyte (Electrolyte concentration (mol/l) / Ammonium ion concentration (mol/l)) | Current density ($A/m^2$) | Treating time (sec) | $Si_{2p}/C_{1s}$ | $N_{1s}/C_{1s}$ | $O_{1s}/C_{1s}$ | Note |
|---|---|---|---|---|---|---|---|
| 2-1 | (1) Ammonium carbonate (0.5/1.0) | 2.5 | 30 | 0.00 | 0.065 | 0.25 | This invention |
| | (2) Ammonium carbonate (0.025/0.05) | 0.5 | 30 | | | | |
| 2-2 | (1) Ammonium carbonate (1.5/3.0) | 2.5 | 30 | 0.00 | 0.069 | 0.23 | |
| | (2) Ammonium carbonate (0.05/0.1) | 0.5 | 30 | | | | |
| 2-3 | (1) Ammonium bicarbonate (3.0/3.0) | 2.5 | 30 | 0.00 | 0.067 | 0.22 | |
| | (2) Ammonium bicarbonate (0.1/0.1) | 0.5 | 30 | | | | |
| 2-4 | (1) Tribasic ammonium phosphate (1.0/3.0) | 2.5 | 30 | 0.00 | 0.066 | 0.23 | |
| | (2) Tribasic ammonium phosphate (0.025/0.075) | 0.5 | 30 | | | | |
| 2-5 | Sulfuric acid (0.5) | 0.5 | 60 | 0.10 | 0.029 | 0.36 | Comparative example |
| 2-6 | Sodium nitrate (0.5) | 0.5 | 60 | 0.10 | 0.026 | 0.39 | |
| 2-7 | Ammonium carbonate (0.25/0.5) | 2.0 | 60 | 0.00 | 0.064 | 0.12 | |
| 2-8 | Untreated | — | — | 0.11 | 0.029 | 0.25 | |

In the above and the following Tables, (1) indicates the conditions of the first stage electrolysis and (2) indicates those of the second stage electrolysis.

EXAMPLE 3

Acrylonitrile fibers of filament number 12,000 and filament size 1.2 denier were flameproofed by stage heating in the range of 200°-300° C. in an oxidizing atmosphere so that density of the fibers after completion of the flameproofing treatment was 1.35-1.36 g/cm³. Thus flameproofed fibers were treated under extension at a heating rate of 200° C./min in the range of 300°-800° C. in an inert atmosphere. Then, the fibers were further subjected to carbonizing treatment at 1300° C. under extension to obtain carbon fibers having an elasticity modulus of 28 t/mm². Then, thus obtained carbon fibers were subjected to electrolysis treatment under the conditions as shown in Table 3. Properties of thus obtained carbon fibers and those of carbon fibers which were not subjected to the surface treatment were evaluated and the results are shown in Table 3.

It is seen that impurities (Si) were removed and simultaneously nitrogen and oxygen-containing functional groups were effectively introduced by the treatment according to this invention and as a result strand strength of the carbon fibers and TS⊥ of composite materials were both improved.

TABLE 3

| Experiment No. | Electrolysis (Electrolyte concentration (mol/l) / Ammonium ion concentration (mol/l)) | Current density ($A/m^2$) | Treating time (sec) | Average nitrogen content in carbon fibers (% by weight) | N/C | $Si_{2p}/C_{1s}$ | $N_{1s}/C_{1s}$ | $O_{1s}/C_{1s}$ | [A] | [B] | [C] | TS⊥ ($kg/mm^2$) | Strand strength ($kg/mm^2$) | Note |
|---|---|---|---|---|---|---|---|---|---|---|---|---|---|---|
| 3-1 | (1) Ammonium carbonate (0.5/1.0) | 3.0 | 30 | 3.45 | 0.031 | 0.00 | 0.047 | 0.22 | 0.101 | 0.22 | 0.016 | 10.7 | 532 | This invention |
| | (2) Ammonium carbonate (0.025/0.05) | 0.5 | 30 | | | | | | | | | | | |
| 3-2 | (1) Ammonium carbonate (1.5/3.0) | 3.0 | 30 | 3.43 | 0.031 | 0.00 | 0.049 | 0.20 | 0.101 | 0.20 | 0.018 | 10.5 | 533 | |
| | (2) Ammonium carbonate (0.05/0.1) | 0.5 | 30 | | | | | | | | | | | |
| 3-3 | (1) Ammonium bicarbonate (3.0/3.0) | 3.0 | 30 | 3.42 | 0.030 | 0.00 | 0.049 | 0.19 | 0.100 | 0.19 | 0.019 | 10.5 | 530 | |
| | (2) Ammonium bicarbonate (0.1/0.1) | 0.5 | 30 | | | | | | | | | | | |
| 3-4 | (1) Tribasic ammonium phosphate (1.0/3.0) | 3.0 | 30 | 3.45 | 0.031 | 0.00 | 0.045 | 0.20 | 0.101 | 0.20 | 0.014 | 10.7 | 535 | |
| | (2) Ammonium carbonate (0.075/0.15) | 0.5 | 30 | | | | | | | | | | | |
| 3-5 | (1) Ammonium carbonate (1.0/1.0) | 3.0 | 30 | 3.42 | 0.030 | 0.00 | 0.047 | 0.21 | 0.100 | 0.21 | 0.017 | 10.3 | 534 | |
| | (2) Ammonium bicarbonate (0.05/0.05) | 0.5 | 30 | | | | | | | | | | | |
| 3-6 | Sulfuric acid (0.5) | 0.5 | 60 | 3.43 | 0.031 | 0.10 | 0.014 | 0.46 | 0.101 | 0.26 | −0.017 | 8.3 | 479 | Comparative examples |
| 3-7 | Sodium nitrate (0.5) | 0.5 | 60 | 3.42 | 0.031 | 0.10 | 0.016 | 0.43 | 0.101 | 0.23 | −0.015 | 8.6 | 482 | |
| 3-8 | Ammonium carbonate (0.25/0.5) | 2.0 | 60 | 3.45 | 0.032 | 0.00 | 0.059 | 0.09 | 0.101 | 0.09 | 0.027 | 9.4 | 528 | |

TABLE 3-continued

| Experiment No. | Electrolysis (Electrolyte concentration (mol/l) / Ammonium ion concentration (mol/l)) | Current density ($A/m^2$) | Treating time (sec) | Average nitrogen content in carbon fibers (% by weight) | N/C | $Si_{2p}/C_{1s}$ | $N_{1s}/C_{1s}$ | $O_{1s}/C_{1s}$ | [A] | [B] | [C] | TS⊥ ($kg/mm^2$) | Strand strength ($kg/mm^2$) | Note |
|---|---|---|---|---|---|---|---|---|---|---|---|---|---|---|
| 3-9 | Ammonium bicarbonate (0.05/0.05) | 0.5 | 60 | 3.42 | 0.031 | 0.08 | 0.020 | 0.40 | 0.101 | 0.24 | −0.011 | 9.2 | 493 | |
| 3-10 | (1) Ammonium bicarbonate (0.15/0.15) | 3.0 | 30 | 3.44 | 0.032 | 0.03 | 0.055 | 0.39 | 0.101 | 0.33 | 0.020 | 9.4 | 490 | |
| | (2) Ammonium bicarbonate (0.05/0.05) | 0.5 | 30 | | | | | | | | | | | |
| 3-11 | Untreated | — | — | 3.43 | 0.032 | 0.11 | 0.014 | 0.25 | 0.101 | 0.03 | −0.018 | 6.0 | 490 | |

(1) and (2) are the same as in Table 2.
[A] = 0.67 N/C + 0.08
[B] = $O_{1s}/C_{1s} - 2Si_{2p}/C_{1s}$
[C] = $N_{1s}/C_{1s}$ − N/C

EXAMPLE 4

Carbon fibers were produced under the same carbonization conditions as in Example 3 except that coagulation take-up rate of precursor was raised to make the filament size 0.9 denier and carbonizing temperature was changed as shown in Table 4. Then, thus obtained carbon fibers were subjected to electrolysis treatment under the conditions as shown in Table 4. Various properties of these carbon fibers and untreated carbon fibers are shown in Table 4.

From the results, it is seen that the carbon fibers obtained according to this invention are superior in both the strand strength and the TS⊥ of composite materials.

TABLE 4

| Experiment No. | Carbonization temperature (°C.) | Electrolyte (Electrolyte concentration (mol/l) / Ammonium ion concentration (mol/l)) | Current density (A/m²) | Treating time (sec) | Average nitrogen content in carbon fibers (% by weight) | N/C | $Si_{2p}/C_{1s}$ | $N_{1s}/C_{1s}$ | $O_{1s}/C_{1s}$ | [A] | [B] | [C] | TS⊥ (kg/mm²) | Strand strength (kg/mm²) | Note |
|---|---|---|---|---|---|---|---|---|---|---|---|---|---|---|---|
| 4-1 | 1300 | (1) Ammonium bicarbonate (2.0/2.0) | 3.0 | 30 | 3.56 | 0.032 | 0.00 | 0.058 | 0.28 | 0.101 | 0.28 | 0.026 | 10.8 | 542 | This invention |
| | | (2) Ammonium bicarbonate (0.1/0.1) | 0.5 | 30 | | | | | | | | | | | |
| 4-2 | 1500 | " | " | " | 3.02 | 0.026 | 0.00 | 0.045 | 0.24 | 0.097 | 0.24 | 0.019 | 10.5 | 568 | |
| 4-3 | 1700 | " | " | " | 1.56 | 0.014 | 0.00 | 0.028 | 0.21 | 0.089 | 0.21 | 0.014 | 10.3 | 572 | |
| 4-4 | 1800 | " | " | " | 0.81 | 0.007 | 0.00 | 0.012 | 0.20 | 0.085 | 0.20 | 0.005 | 10.0 | 579 | |
| 4-5 | 1100 | " | " | " | 5.21 | 0.047 | 0.00 | 0.080 | 0.31 | 0.111 | 0.31 | 0.033 | 10.2 | 485 | Comparative examples |
| 4-6 | " | Untreated | — | — | 5.21 | 0.047 | 0.11 | 0.029 | 0.28 | 0.111 | 0.06 | −0.018 | 6.5 | 453 | |
| 4-7 | 1300 | Sulfuric acid (0.5) | 0.5 | 60 | 3.58 | 0.032 | 0.10 | 0.020 | 0.45 | 0.101 | 0.25 | −0.012 | 8.2 | 485 | |
| 4-8 | " | Ammonium carbonate (0.075/0.15) | 0.5 | 60 | 3.60 | 0.032 | 0.04 | 0.055 | 0.31 | 0.101 | 0.23 | 0.023 | 9.2 | 506 | |
| 4-9 | 1300 | Untreated acid | — | — | 3.60 | 0.032 | 0.10 | 0.020 | 0.24 | 0.101 | 0.04 | −0.012 | 6.0 | 502 | |
| 4-10 | 1500 | Sulfuric acid (0.5) | 0.5 | 60 | 3.02 | 0.026 | 0.05 | 0.008 | 0.33 | 0.097 | 0.23 | −0.018 | 7.8 | 480 | |
| 4-11 | " | (1) Ammonium carbonate (1.0/2.0) | 3.0 | 30 | 3.03 | 0.027 | 0.00 | 0.018 | 0.27 | 0.098 | 0.27 | −0.009 | 8.0 | 491 | |
| | | (2) Phosphoric acid (0.5) | 0.5 | 30 | | | | | | | | | | | |
| 4-12 | " | Untreated | — | — | 3.04 | 0.027 | 0.05 | 0.007 | 0.13 | 0.098 | 0.03 | −0.020 | 5.4 | 511 | |
| 4-13 | 1700 | Sodium nitrate (0.5) | 0.5 | 60 | 1.56 | 0.014 | 0.03 | <0.003 | 0.20 | 0.089 | 0.18 | −0.014~−0.011 | 7.3 | 473 | |
| 4-14 | " | (1) Ammonium carbonate (0.075/0.15) | 3.0 | 30 | 1.54 | 0.013 | 0.03 | 0.026 | 0.37 | 0.089 | 0.31 | 0.013 | 8.1 | 515 | |
| | | (2) Ammonium carbonate (0.05/0.1) | 0.5 | 30 | | | | | | | | | | | |
| 4-15 | " | Untreated | — | — | 1.56 | 0.014 | 0.03 | <0.003 | 0.04 | 0.089 | 0.02 | −0.014~−0.011 | 5.0 | 513 | |
| 4-16 | 1800 | Sodium hydroxide (0.5) | 0.5 | 60 | 0.81 | 0.007 | 0.00 | <0.003 | 0.10 | 0.085 | 0.10 | −0.007~−0.004 | 7.5 | 478 | |

TABLE 4-continued

| Experiment No. | Carbonization temperature (°C.) | Electrolyte (Electrolyte concentration (mol/l) / Ammonium ion concentration (mol/l)) | Current density ($A/m^2$) | Treating time (sec) | Average nitrogen content in carbon fibers (% by weight) | N/C | $Si_{2p}/C_{1s}$ | $N_{1s}/C_{1s}$ | $O_{1s}/C_{1s}$ | [A] | [B] | [C] | TS⊥ ($kg/mm^2$) | Strand strength ($kg/mm^2$) | Note |
|---|---|---|---|---|---|---|---|---|---|---|---|---|---|---|---|
| 4-17 | " | Ammonium bicarbonate (3.0/3.0) | 3.0 | 60 | 0.81 | 0.007 | 0.00 | 0.006 | 0.08 | 0.085 | 0.08 | −0.001 | 8.0 | 542 | |
| 4-18 | " | Untreated | — | — | 0.82 | 0.007 | 0.00 | <0.003 | 0.01 | 0.085 | 0.01 | −0.007~−0.004 | 4.6 | 503 | |
| 4-19 | 2000 | (1) Ammonium bicarbonate (2.0/2.0) | 3.0 | 30 | 0.32 | 0.003 | 0.00 | 0.007 | 0.10 | 0.082 | 0.10 | 0.004 | 8.2 | 496 | |
| | | (2) Ammonium bicarbonate (0.1/0.1) | 0.5 | 30 | | | | | | | | | | | |
| 4-20 | " | Untreated | — | — | 0.32 | 0.003 | 0.00 | <0.003 | 0.005 | 0.082 | 0.005 | −0.003~0.000 | 4.2 | 471 | |

(1) and (2) are the same as in Table 2.
[A] = 0.67 N/C + 0.08
[B] = $O_{1s}/C_{1s} - 2Si_{2p}/C_{1s}$
[C] = $N_{1s}/C_{1s}$ − N/C As is clear from the above explanation, as compared with carbon fibers made by applying the conventional electrolytic oxidation, the carbon fibers obtained by this invention have the characteristics that TS⊥ of composite materials made therefrom is greatly improved and furthermore, strand strength which is reduced according to the ordinary electrolysis is greatly improved over that of untreated carbon fibers. Thus, according to this invention, carbon fibers of at least 530 $Kg/mm^2$ in strand strength and at least 24 $t/mm^2$ in strand elasticity modulus and at least 10 $Kg/mm^2$ of TS⊥ (composite materials) can easily be obtained.

What is claimed is:

1. Polyacrylonitrile based carbon fibers which have an average nitrogen content within the whole of the carbon fibers of 0.5–4.5% by weight, based on a measured elemental analysis, and which satisfy the following relationships when subjected to X-ray photoelectron spectroscopy measurements:

$$0 \leqq Si_{2p}/C_{1s} \leqq 0.02$$

$$0.67\ N/C + 0.08 \leqq O_{1s}/C_{1s} - 2\ Si_{2p}/C_{11} \leqq 0.4$$

$$0 \leqq N_{1s}/C_{1s} - N/C \leqq 0.04,$$

wherein the ratio N/C is an atom number ratio based on the measured elemental analysis data for nitrogen to carbon, the ratio $Si_{2p}/C_{1s}$ is an atom number ratio of surface silicon concentration to carbon, the ratio $N_{1s}/C_{1s}$ is an atom number ratio of surface nitrogen concentration to carbon, and the ratio $O_{1s}/C_{1s}$ is an atom number ratio of surface oxygen concentration to carbon, which have a strand strength of at least 530 $kg/mm^2$ and which provide a composite material made therefrom which has a TS⊥ of at least 10 $kg/mm^2$.

2. The polyacrylonitrile based carbon fibers of claim 1, wherein said elemental nitrogen analysis ranges from 0.5–3.5% by weight.

3. The polyacrylonitrile based carbon fibers of claim 1, wherein said $Si_{2p}/C_{1s}$ ratio is less than 0.01.

* * * * *